United States Patent [19]

Biornstad

[11] 3,935,061

[45] Jan. 27, 1976

[54] STOCK INLET FOR A PAPER MACHINE

[75] Inventor: Peter Biornstad, Ravensburg, Germany

[73] Assignee: Escher Wyss GmbH, Ravensburg, Germany

[22] Filed: Dec. 4, 1973

[21] Appl. No.: 421,606

[30] Foreign Application Priority Data

Dec. 11, 1972 Switzerland ..... 17969/72

[52] U.S. Cl. ..... 162/252; 162/198; 162/259

[51] Int. Cl.[2]..... D21F 1/02; D21F 1/04; D21F 1/06

[58] Field of Search ..... 162/252, 258, 259, 297, 162/317, 340, 363, 364, 263, 253

[56] References Cited

UNITED STATES PATENTS

| | | | |
|---|---|---|---|
| 3,005,490 | 10/1961 | Justus | 162/252 |
| 3,487,686 | 1/1970 | Salomon | 162/263 X |
| 3,631,982 | 1/1972 | Lejeune | 162/340 X |
| 3,642,573 | 2/1972 | Genz et al. | 162/364 |
| 3,741,865 | 6/1973 | Lejeune | 162/317 |
| 3,764,465 | 10/1973 | Bartley et al. | 162/364 X |

*Primary Examiner*—Robert L. Lindsay, Jr.
*Assistant Examiner*—Steve Alvo
*Attorney, Agent, or Firm*—Kenyon & Kenyon Reilly Carr & Chapin

[57] ABSTRACT

The vacuum pressure in the suction box which extends across the sheet-forming zone and terminates at the end of the zone is controlled in dependence on the pressure of the stock in the inlet duct opposite the suction box in order to maintain a constant column of stock liquid in the inlet duct at the end of the inlet duct. Various combinations of vacuum controlled suction boxes can be used.

8 Claims, 5 Drawing Figures

STOCK INLET FOR A PAPER MACHINE

This invention relates to a stock inlet for a paper machine.

Paper machines have been known to include a movable water-permeable element, which may be a roll having a cylinder mold or a flat wire, to which stock is fed via a feed duct which extends along a sheet-forming zone of the element and terminates at the end of the zone. Generally, the stock is fed to the inlet duct in a constant quantity per unit of time and at least one suction box is disposed in the region of the sheet-forming zone on that side of the permeable element which is remote from the inlet duct. The suction box is usually connected to a vacuum source in order to draw out the water from the stock on the movable element.

The quality of a paper made on a paper machine depends upon a satisfactory supply of the stock at the stock inlet to the permeable element. It is therefore important that the feed or inlet duct should always be filled with stock, i.e., a suspension of fibers, fillers, etc., in water, as far as the end. At the same time, care must be taken to prevent the stock at the end of the inlet duct from escaping onto the fleece which has already formed on the permeable element, since this would cause damage to the fleece. In these circumstances, one of the difficulties experienced is that the stock must be supplied in a constant quantity per unit of time in the case of a permeable element moving at a constant speed, if a fleece of uniform thickness and density is to be formed. The permeability of the fleece forming on the element in the sheet-forming zone may vary, however, so that the water forming the suspension flows away from the feed duct through the element too soon or else, in the case of a lower permeability, overflows from the inlet duct to the end.

Accordingly, it is an object of the invention to provide a stock inlet which can be kept full to the end during operation while at the same time the stock or water is prevented from escaping onto the fleece already formed.

Briefly, the invention provides a paper machine having a movable water-permeable element, a stock supplying feed duct having an outlet extending over and terminating at one end of a sheet-forming zone of the element, at least one suction box in the sheet-forming zone opposite the feed duct and a vacuum source connected to the box to evacuate the box. The suction box is also provided with a control means for controlling the vacuum and the feed duct is provided with a sensor for measuring the stock pressure operative in the sheet-forming zone. The sensor is connected to the control device to deliver a measurement signal to the control device in response to the stock pressure. In this way, the control device adjusts the vacuum in dependence on the measuring signal of the sensor so that the end of the column of stock liquid is situated at the end of the feed duct.

By controlling the vacuum in the suction box, the takeup of stock from the inlet duct can be so controlled as to maintain the required condition.

Preferably, the suction box connected to the control means terminates, as considered in the direction of movement of the permeable element, in the region of the place where the end of the feed duct is situated. This gives an optimum action on the part of the control means, since the end of the feed duct which is very important to the control process can be influenced and at the same time the flow of secondary air from the permeable element zone situated after the feed duct is obviated.

In another embodiment, a second suction box is disposed, as considered in the direction of movement of the permeable element, in front of and/or after the suction box provided with the control means for the vacuum, and is connected to a vacuum source having a constant vacuum value. In this way, the stock inlet and the paper machine can be simplified and the cost thereof reduced, since the control does not have to influence all of the air drawn in through the permeable element, but only a part of the air.

According to another embodiment of the invention, a plurality of suction boxes are disposed serially as considered in the direction of movement of the permeable element and are provided with control means for the vacuum. At least one pressure sensor is provided on the duct wall in the zone of each of the suction boxes for transmitting a signal to the associated control means. This gives a very effective control whereby the pressure and flow conditions of the stock in that part of the feed duct situated above the suction boxes can be influenced.

According to another embodiment of the invention, a plurality of pressure sensors are disposed on the wall of the duct transversely of the direction of movement of the permeable element and their signals are fed in combination to the control means. With such a construction, it is possible to allow for pressure differences which may form in the feed duct in the transverse direction of the wire or in the axial direction of a suction roll.

According to another embodiment of the invention, a plurality of suction boxes are disposed side-by-side in the transverse direction of the permeable element and are connected to separate control means for the vacuum, a pressure sensor which influences the control device being associated with each such suction box. In this way, it is possible for optimum consideration to be given to different influences in the transverse direction of the permeable element.

The permeable element may, for example, be a suction couch roll around which is secured a cylinder mold or the permeable element may be a flat wire.

DESCRIPTION OF THE PREFERRED EMBODIMENTS

Figure 1:
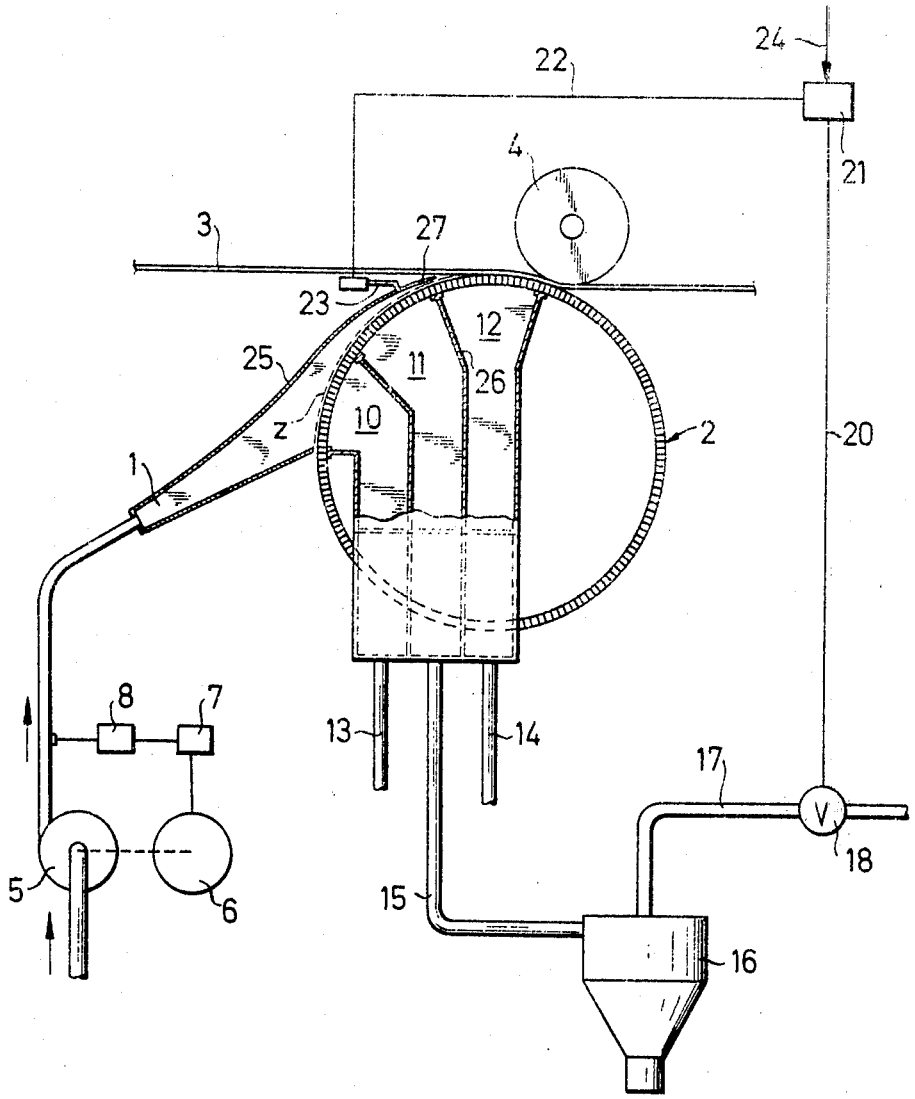
Figure 2:
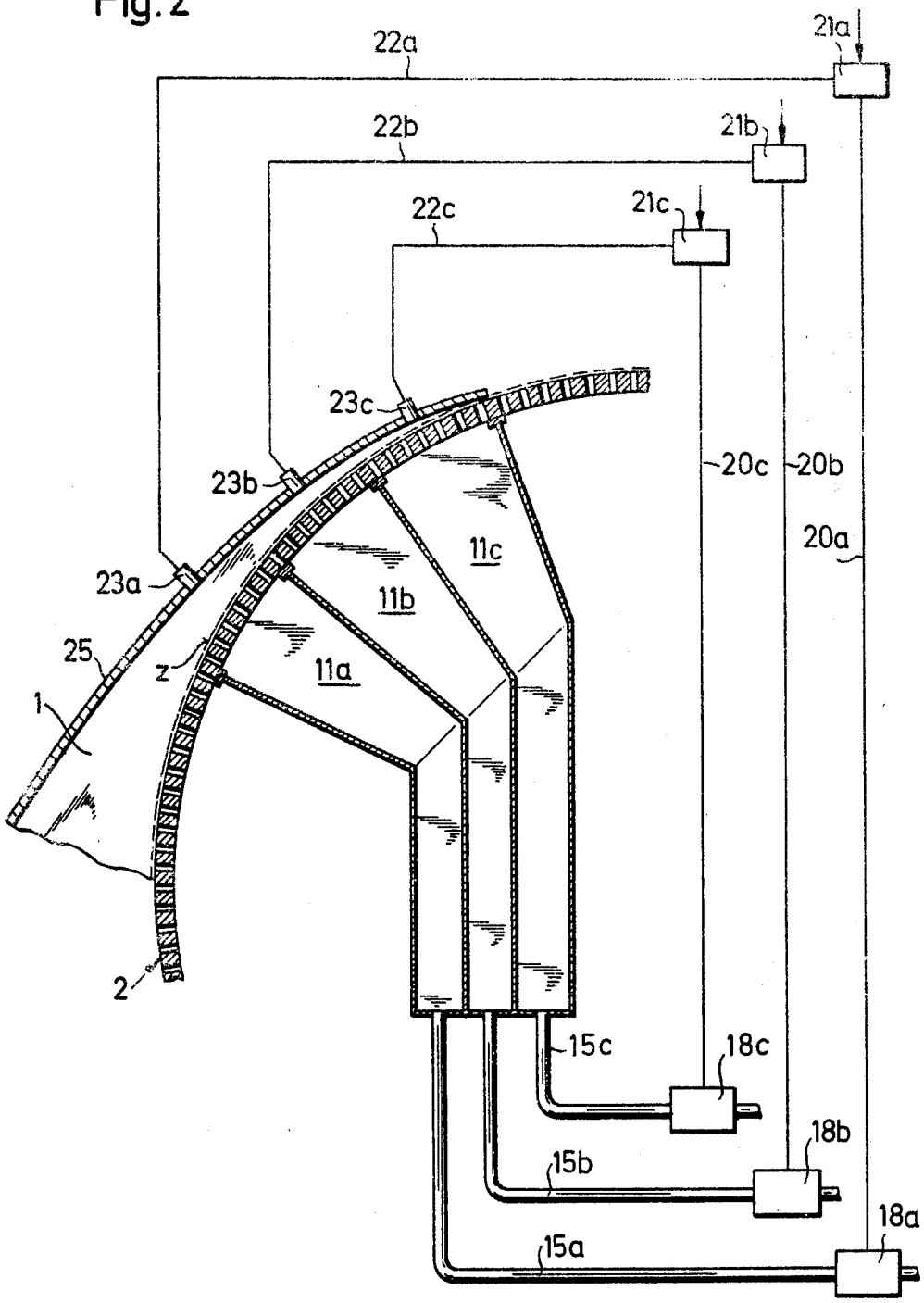
Figure 3:
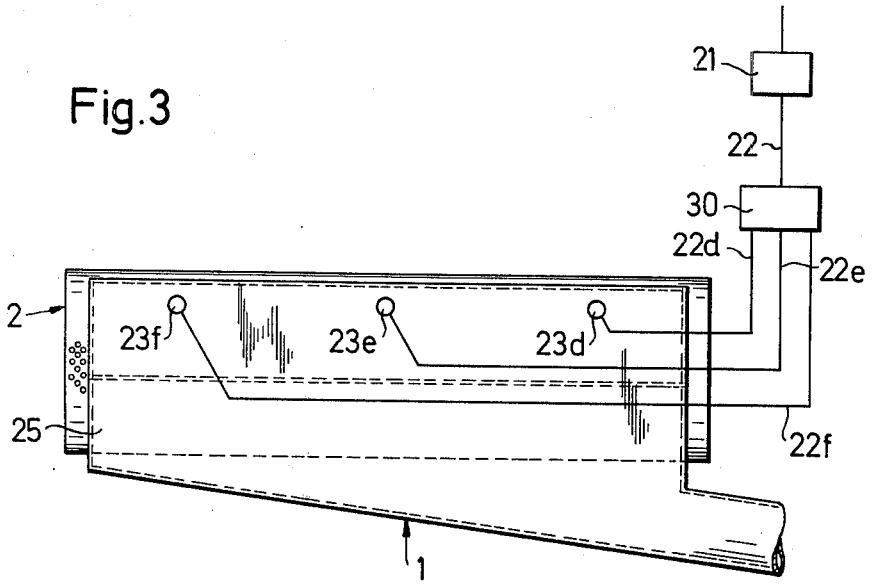
Figure 4:
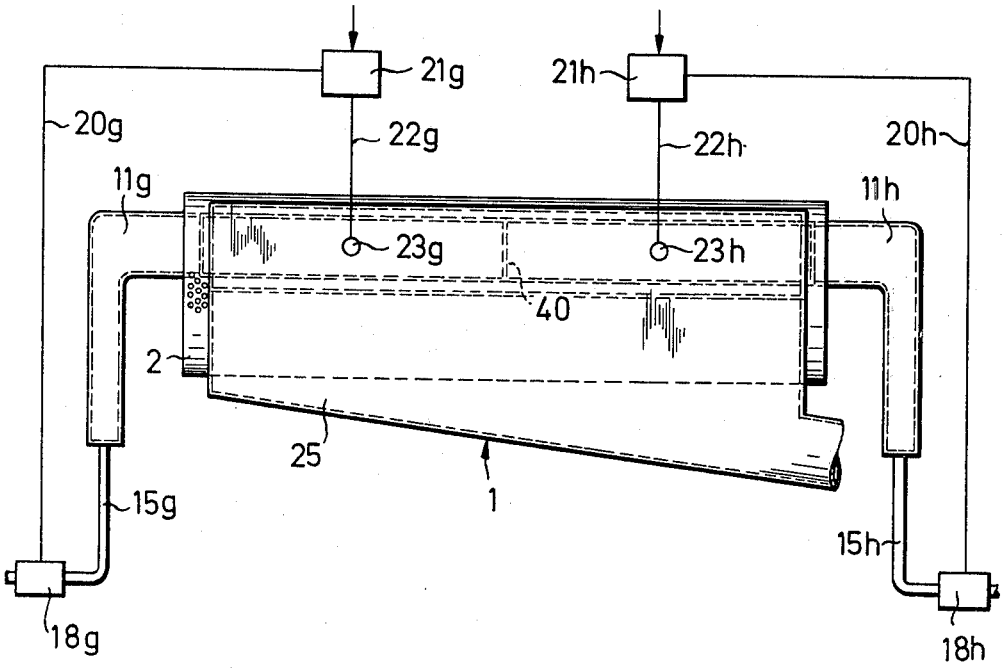
Figure 5:
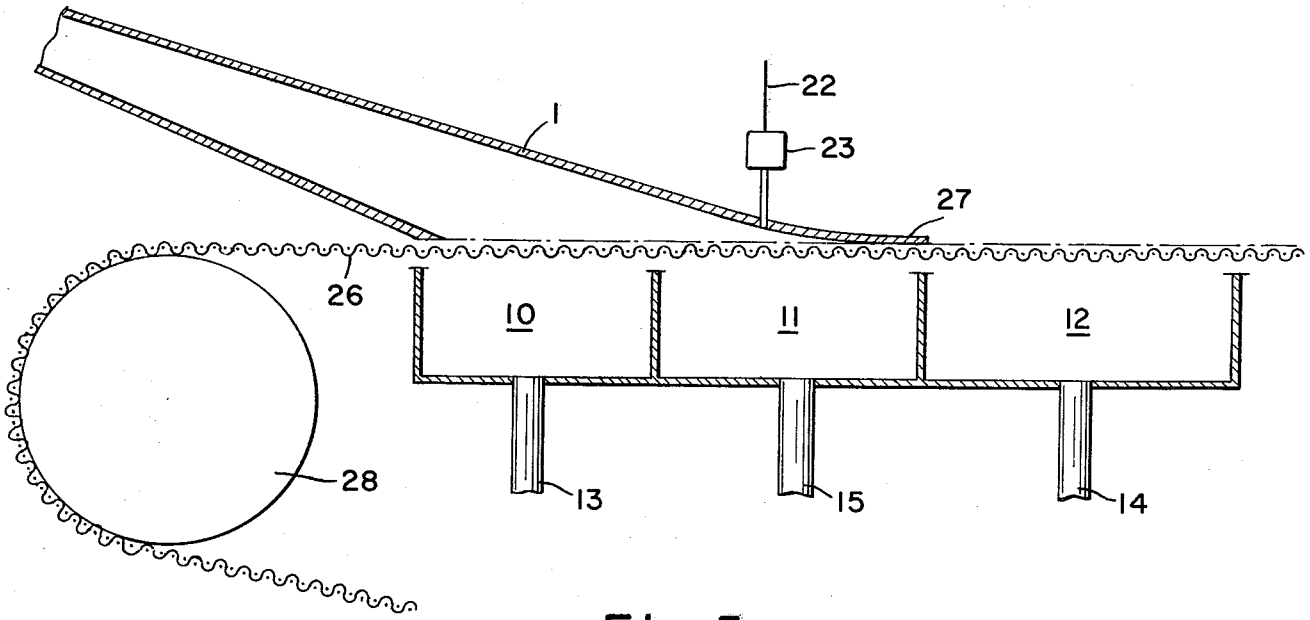

FIG. 1 diagramatically illustrates a first embodiment of the invention with a diagrammatic section of a feed duct and suction roll and a partial section of the suction boxes according to the invention;

FIG. 2 illustrates a view of a further embodiment utilizing a plurality of suction boxes with a controlled vacuum;

FIG. 3 diagrammatically illustrates another embodiment of the stock inlet looking from the left in FIG. 1 to a somewhat smaller scale;

FIG. 4 illustrates another embodiment of the invention in a similar view to FIG. 3; and FIG. 5 illustrates another embodiment of the invention utilizing a flat wire as the permeable element.

Referring to FIG. 1, as is known, the stock inlet of a paper machine compreses an inlet or feed duct 1 and a water-permeable element in the form of a suction couch roll 2, around which is secured a cylinder mold. A felt web 3 is guided over the roller 2 and is pressed against the roller 2 by a couch roll 4 in order to take off the paper fleece formed on the roll 2. The stock is feed to the duct 1 by a means such as a pump 5 from a tank (not shown); the pump 5 being driven by a controllable electric motor 6. The motor 6 is controlled by a controller 7 in dependence on a stock sensor 8 so that the stock is fed at a constant quantity per unit of time. The duct 1 extends over part of the mold on the roll 2 to form a sheet-forming zone Z on the roll 2.

Inside the shell of the suction roll 2 are suction boxes 10, 11, 12, which may be constructed in known manner. The outer suction boxes 10 and 12 are connected via conduits 13 and 14 to a vacuum source (not shown) having a constant vacuum. The middle suction box 11 is connected via a conduit 15 containing a water separator 16 to a conduit 17 which leads to a vacuum source (not shown) and contains a control means such as a valve 18. This valve 18 is influenced via a control line 20 by a controller 21 which receives a signal from a pressure sensor 23 via a signal line 22. The pressure sensor signal is compared in the controller 21 with an adjustable set-value 24.

The pressure sensor 23 is disposed on a wall 25 of the feed duct 1 and measures the pressure of the stock suspension in the duct 1 in the region of the suction box 11 and hence in the sheet-forming zone Z. As will be apparant from FIG. 1, the suction box 11, as considered in the direction of movement of the suction roll 2, terminates in a wall 26 at the place where the end 27 of the duct 1 is situated.

In operation, the pressure sensor 23 delivers a signal indicative of the stock pressure adjacent the suction box 11 in the sheet-forming zone Z to the controller 21. After comparison with the set-value, a difference signal or the like corresponding to a deviation from the set-value is delivered to the valve 18 to open or close the same in order to vary the vacuum pressure in the suction box 11. As a result, more or less water is drawn through the box 11 so that the column of stock in the duct 1 is maintained constant.

Referring to FIG. 2, instead of having one controlled suction box, a plurality of suction boxes 11*a*, 11*b* and 11*c* can be disposed serially inside the suction roll 2. Each box 11*a*, 11*b*, 11*c* is connected via suction conduits 15*a*, 15*b*, 15*c* containing pressure adjusting means 18*a*, 18*b*, 18*c*, to a common vacuum source or to separate vacuum sources. Also, pressure adjusting means 18*a*, 18*b*, and 18*c* are connected to controllers 21*a*, 21*b*, 21*c* via control lines 20*a*, 20*b*, 20*c*. The controllers 21*a*, 21*b*, 21*c* also receive signals from pressure sensors 23*a*, 23*b*, 23*c* via signal lines 22*a*, 22*b*, 22*c*. The pressure sensors 23*a*, 23*b*, 23*c* are each situated in the wall 25 of the duct 1 at places in the region of their associated suction box 11*a*, 11*b*, 11*c*, respectively.

Referring to FIG. 3, pressure sensors 23*d*, 23*e*, 23*f* can also be provided which feed their signals via signal lines 22*d*, 22*e*, 22*f* to a computing element 30 from which a signal dependent upon the three measuring signals is fed to the controller 21 via the signal line 22. In this case, the pressure sensors are distributed in the duct wall 25 transversely of the direction of movement of the suction roll 2. Their measuring signals are combined in the computer means 30. The controller 21 acts on a vacuum adjusting means which influences the vacuum in a suction box (not shown) which may, for example, correspond to the suction box 11 shown in FIG. 1 and extends through the entire suction roll.

Referring to FIG. 4, which is shown in the same way as FIG. 3, the suction roll 2 contains two suction boxes

11*g* and 11*h*, which correspond substantially to a suction box 11 provided with a partition 40 in the middle. The two suction boxes 11*g* and 11*h* are connected to vacuum sources (not shown) via suction conduits 15*g* and 15*h* containing adjusting means 18*g* and 18*h*. The two suction boxes 11*g* and 11*h* are associated with pressure sensors 23*g* and 23*h*, each connected to a controller 21*g* and 21*h* via signal lines 22*g* and 22*h*. As in the previously described exemplified embodiments, the controllers 21*g* and 21*h* are used to influence the vacuum in the suction boxes 11*g* and 11*h* and hence to control the stock liquid pressure operative in the relevant section of the inlet duct 1.

It will be evident that the exemplified embodiments shown in the individual Figures may also be suitably combined with one another. Although the permeable element described and illustrated in every case is a suction roll 2 with a cylinder mold, the element can be in the form of a flat wire, which may extend horizontally or at an angle. For example, as shown in FIG. 5, wherein like reference characters have been used to indicate like parts as above, the water permeable element in the form of a flat wire 26 which is passed over a roller 28 before moving across the suction boxes 10, 11, 12.

Although a valve 18 is used in FIG. 1 to control the vacuum in the suction box 11, the vacuum can be controlled in any known manner, for example by secondary air supply, vacuum pump speed control, and so on.

The sensor shown in the examples for measuring the pressure operative in the duct is a pressure sensor disposed in the wall. In principle, however, the pressure may be measured indirectly, e.g., a force dependent upon the pressure being measured. Further, the pressure measurement need not be carried out at a place situated opposite the associated suction box. In principle, measurement at some other place in the feed duct 1 is possible, although it is necessary to take into account the static and dynamic pressure difference between the place at which the measurement is carried out and the end of the feed duct, for example by appropriate adjustment of the set-value 24.

With regard to the computer means 30 of the device shown in FIG. 3, the same may be a simple summation means which forms a sum of the three measuring signals supplied, a means for forming an arithmetic or a geometric mean, or means for forming a value dependent upon the three measuring signals, in which the influence of the individual measuring signals on the output signal may be in accordance with any desired function.

What is claimed is:

1. In a paper machine, the combination of a movable water-permeable element;

a feed duct for supplying stock onto said element, said duct having an outlet extending over a sheet-forming zone of said element and terminating at one end of said zone;

means for feeding stock to said feed duct at a constant quantity per unit of time;

at least one suction box disposed in the region of said zone on a side opposite said feed duct;

a vacuum source connected to said suction box to evacuate said box;

a control means for controlling the vacuum in said suction box; and a sensor in said feed duct for measuring the stock pressure in said zone, said sensor being connected to said control means to deliver a signal thereto indicative of the stock pressure, wherein said control means controls the vacuum in said vacuum box in response to deviations of said signal from a set value to maintain a constant column of stock at said outlet of said feed duct.

2. In a paper machine as set forth in claim 1 wherein said suction box terminates at said one end of said sheet-forming zone.

3. In a paper machine as set forth in claim 1 which further includes a second suction box downstream of the first suction box, and means connected to said second suction box to maintain a constant vacuum therein.

4. In a paper machine as set forth in claim 1 including a plurality of said suction boxes, said boxes being disposed in series, and a plurality of said sensors and control devices, each respective sensor and control device being connected with a respective suction box.

5. In a paper machine as set forth in claim 1 including a plurality of said sensors disposed transversely of said feed duct relative to the flow of stock, said sensors each being connected to said control device to deliver respective signals thereto.

6. In a paper machine as set forth in claim 1 including a plurality of suction boxes disposed side-by-side transversely across said feed duct, and a plurality of said sensors and control devices, each respective sensor and control device being connected with a respective suction box.

7. In a paper machine as set forth in claim 1 wherein said element is a suction couch roll having a cylinder mold secured thereto.

8. In a paper machine as set forth in claim 1 wherein said element is a flat wire.

* * * * *